US005223382A

United States Patent [19]

Ohno

[11] Patent Number: 5,223,382

[45] Date of Patent: Jun. 29, 1993

[54] SILVER HALIDE PHOTOGRAPHIC MATERIAL

[75] Inventor: Shigeru Ohno, Kanagawa, Japan

[73] Assignee: Fuji Photo Film Co., Ltd., Kanagawa, Japan

[21] Appl. No.: 983,701

[22] Filed: Dec. 1, 1992

[30] Foreign Application Priority Data

Dec. 2, 1991 [JP] Japan ..... 3-318201

[51] Int. Cl.[5] ..... G03C 1/06

[52] U.S. Cl. ..... 430/522; 430/510; 430/517

[58] Field of Search ..... 430/522, 510, 517, 593, 430/594, 595

[56] References Cited

U.S. PATENT DOCUMENTS

| | | | |
|---|---|---|---|
| 3,926,970 | 12/1935 | Sauter | 430/522 |
| 4,294,916 | 10/1981 | Postle et al. | 430/522 |
| 4,294,917 | 12/1981 | Postle et al. | 430/522 |
| 4,713,316 | 12/1987 | Kubodera et al. | 430/522 |

*Primary Examiner*—Jack P. Brammer
*Attorney, Agent, or Firm*—Sughrue, Mion, Zinn, Macpeak & Seas

[57] ABSTRACT

A silver halide photographic material containing a dye that can be quickly decolored during development processing and can provide the light-sensitive material with excellent sharpness and less residual color. The light-sensitive material is characterized by having a hydrophilic colloid layer containing a dye represented by formula (I):

wherein Z represents a group of non-metallic atoms necessary to form a 5 or 6-membered nitrogen-containing heterocyclic ring; $R_1$, $R_2$, $_3$, $R_4$ and $R_5$ each represent a hydrogen atom or a monovalent group, and $R_3$ and $R_4$ and/or $R_4$ and $R_5$ may be combined to form a 5 or 6-membered ring; $R_6$ represents an alkyl group, an alkenyl group or an aryl group; $L_1$, $L_2$, $L_3$ and $L_4$ each represent a methine group; $X^-$ represents an anion; m represents 1 or 2; n represents 0 or 1; and p represents 0, ½ or 1, provided that when the dye forms an intermolecular salt, p is 0.

6 Claims, No Drawings

SILVER HALIDE PHOTOGRAPHIC MATERIAL

FIELD OF THE INVENTION

The present invention relates to a silver halide photographic light-sensitive material in which a novel photographic dye is used.

BACKGROUND OF THE INVENTION

In a silver halide photographic material, a photographic emulsion layer and the other hydrophilic colloid layers are often colored for the purpose of absorbing a light of a specific wavelength range.

When it is necessary to control a spectral composition of a light incident to a photographic emulsion layer, a colored layer is usually provided farther from a support than the photographic emulsion layer. Such a colored layer is called a filter layer. Where more than one photographic emulsion layer are involved, the filter layer may be interposed between them.

For the purpose of preventing a fuzziness of an image, that is, a halation caused by light which is scattered in or after passing through a photographic emulsion layer and is reflected on the interface between the emulsion layer and support or the surface of a support side opposite to the emulsion layer to get once again in the photographic emulsion layer, a colored layer called an anti-halation layer is placed between the photographic emulsion layer and support or on the support side opposite to the photographic emulsion layer. When one or more photographic emulsion layers are involved, the anti-halation layer may be interposed between them.

The photographic emulsion layer is sometimes colored in order to prevent the deterioration of an image sharpness (in general, this phenomenon is called "irradiation") caused by a light scattered in the photographic emulsion layer. Dyes are usually incorporated into these layers to be colored. These dyes should satisfy the following conditions:

(1) having an appropriate spectral absorption according to use purposes;

(2) being photochemically inactive, that is, causing no bad chemical effects such as, for example, reduction of a sensitivity, degradation of a latent image and fogging to the characteristics of a silver halide photographic material;

(3) being able to be bleached in photographic processing steps or eluted in a processing solution or water for washing so as to leave no harmful color on a processed photographic material;

(4) not diffusing from the colored layer to other layers; and (5) having an excellent aging stability while in solution or in the photographic material and not discoloring or fading.

In particular, when a colored layer is a filter layer or an anti-halation layer provided on the same side of a support as the photographic emulsion layer, it is often necessary for those filter or anti-halation layers to be selectively colored and for the other layers to not be substantially colored; otherwise not only would a harmful spectral effect be exerted on the other layers, but also the intended effect of the filter layer or anti-halation layer is reduced. However, a layer containing a dye, when wet, contacts other hydrophilic layers and often results in a part of the dye being diffused from the former to the latter.

Many efforts have so far been made to prevent such a diffusion of the dye. For example, such methods are disclosed in U.S. Pat. Nos. 2,548,564, 4,124,386 and 3,625,694, in which a hydrophilic polymer having a charge opposite to a dissociated anionic dye is permitted to coexist as a mordant in a layer to localize the dye in a specific layer by means of an interaction with a dye molecule.

Further, the methods in which a specific layer is colored with a water insoluble solid dye are disclosed in JP-A-56-12639 (the term "JP-A" as used herein means an unexamined published Japanese patent application), 55-155350, 55-155351, 63-27838, and 63-197943, European Patents 15,601, 274,723, 276,566 and 299,435, U.S. Pat. No. 4,803,150, and Published International Patent Application (WO)88/04794.

Furthermore, methods are disclosed in U.S. Pat. Nos. 2,719,088, 2,496,841 and 2,496,843, and JP-A-60-45237 in which a specific layer is colored with fine metal salt particles on which dyes are adsorbed.

However, even if these improved methods are used, the decoloring speed for development processing is still so slow and it creates a problem. The decoloring function does not necessarily occur when various factors are changed; such factors include conversion to a rapid processing, improvement in the composition of a processing solution and improvement in the composition of a photographic emulsion.

SUMMARY OF THE INVENTION

An object of the present invention is to provide a photographic material containing a dye that colors a specific layer in the photographic material and, furthermore, is quickly decolored during a development processing.

It has been found by the present inventor that the object of the present invention can be achieved with silver halide photographic material characterized by having at least one hydrophilic colloid layer containing a dye represented by the following Formula (I):

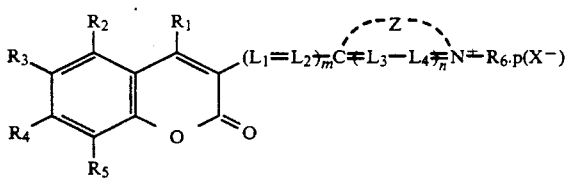

wherein Z represents a group of non-metallic atoms necessary to form a 5 or 6-membered nitrogen-containing heterocyclic ring; $R_1$, $R_2$, $R_3$, $R_4$ and $R_5$ each represent a hydrogen atom or a monovalent group, and $R_3$ and $R_4$ and/or $R_4$ and $R_5$ may be combined to form a 5 or 6-membered ring; $R_6$ represents an alkyl group, an alkenyl group or an aryl group; $L_1$, $L_2$, $L_3$ and $L_4$ each represent a methine group; $X^-$ represents an anion; m represents 1 or 2; n represents 0 or 1; and p represents 0, ½ or 1, provided that when the dye forms an intermolecular salt, p is 0.

Further, it has been found by the present inventor that the object of the present invention can be achieved by a silver halide photographic material characterized by containing a solid fine grain dispersion of the dye represented by the above Formula (I).

DETAILED DESCRIPTION OF THE INVENTION

Formula (I) will be explained below in detail.

Examples of the 5 or 6-membered ring formed by the group of non-metallic atoms represented by Z include an oxazole ring, a benzoxazole ring, a naphthoxazole ring, an isoxazole ring, a thiazole ring, a benzothiazole ring, a naphthothiazole ring, an indolenine ring, a benzindolenine ring, an imidazole ring, a benzimidazole ring, a naphthoimidazole ring, a quinoline ring, and a pyridine ring.

The 5 or 6-membered ring formed by the group of non-metallic atoms represented by Z may be either a condensed ring or have a substituent. Examples of the substituent which the 5 or 6-membered ring formed by the group of non-metallic atoms represented by Z may have include a sulfonic acid group, a carboxylic acid group, a phosphoric acid group, a sulfonamide group having 1 to 10 carbon atoms (for example, methanesulfonamide, benzenesulfonamide and butanesulfonamide), a sulfonylcarbamoyl group having 2 to 10 carbon atoms (for example, methanesulfonyl-carbamoyl and propanesulfonylcarbamoyl), an alkyl group having 1 to 8 carbon atoms (for example, methyl, ethyl, isopropyl, butyl, hexyl, and octyl), an alkoxy group having 1 to 8 carbon atoms (for example, methoxy, ethoxy, and sulfobutoxy), a halogen atom (for example, chlorine, bromine and fluorine), an amino group having 0 to 10 carbon atoms (for example, dimethylamino, diethylamino, and carboxyethylamino), an ester group having 2 to 10 carbon atoms (for example, methoxy-carbonyl), an amido group (for example, acetylamino and benzamide), a carbamoyl group having 1 to 10 carbon atoms (for example, methylcarbamoyl and ethylcarbamoyl), a sulfamoyl group having 1 to 10 carbon atoms (for example, methylsulfamoyl, butylsulfamoyl, and phenylsulfamoyl), an aryl group having 6 to 10 carbon atoms (for example, phenyl and naphthyl), an acyl group having 2 to 10 carbon atoms (for example, acetyl, benzoyl and propanoyl), a sulfonyl group having 1 to 10 carbon atoms (for example, methanesulfonyl and benzenesulfonyl), a ureido group having 1 to 10 carbon atoms (for example, ureido and methylureido), a urethane group having 2 to 10 carbon atoms (for example, methoxycarbonylamino and ethoxycarbonylamino), a cyano group, a hydroxyl group, and a nitro group.

The monovalent group represented by $R_1$, $R_2$, $R_3$, $R_4$ or $R_5$ include the above-mentioned substituents which the 5 or 6-membered ring formed by the group of non-metallic atoms represented by Z may have.

As the monovalent group represented by $R_4$, particularly preferred is an amino group having 2 to 10 carbon atoms (for example, dimethylamino, diethylamino, N-methyl-N-carboxyethylamino, N-ethyl-N-sulfobutylamino, and N-ethyl-N-cyanoethylamino).

Examples of the ring formed by combining $R_3$ and $R_4$ and/or $R_4$ and $R_5$ include a tetrahydroquinoline ring and a julolidine ring.

Preferred as the alkyl group represented by $R_6$ is an alkyl group having 1 to 10 carbon atoms (for example, methyl, ethyl, benzyl, phenethyl, propyl, butyl, isobutyl, pentyl, hexyl, octyl, and nonyl), and may have a substituent(s) (for example, there can be given the substituents which the 5 or 6-membered ring formed by the group of non-metallic atoms represented by above Z may have). Preferred as the alkenyl group represented by $R_6$ is an alkenyl group having 2 to 10 carbon atoms (for example, vinyl, allyl, 1-propenyl, 2-pentenyl, and 1,3-butadienyl). Preferred as the aryl group represented by $R_6$ is an aryl group having 6 to 10 carbon atoms (for example, phenyl and naphthyl), and may have a substituent (for example, there can be given the substituents which the 5 or 6-membered ring formed by the group of non-metallic atoms represented by above Z may have).

The methine group represented by $L_1$, $L_2$, $L_3$ or $L_4$ may have a substituent (for example, methyl and ethyl) but is preferably non-substituted.

Preferred as the anion represented by $X^-$ is a halogen ion (for example, $Cl^-$ and $Br^-$), $CH_3OSO^-$, a sulfuric acid ion, a hydrogensulfate ion, a sulfonic acid ion (for example, a p-toluenesulfonic acid ion, a naphthalene-1,5-disulfonic acid ion, and a trifluromethanesulfonic acid ion), an acetic acid ion, an oxalic acid ion, a tetrafluoroboric acid ion, $PF_6^-$: $ClO_4$, $NO_3^-$, and a heteropolyacid ion (for example, a tungstic acid ion).

In the dye represented by Formula (I), a sulfonic acid group, a carboxylic acid group and a phosphoric acid group may be free acid or may form a salt (for example, an alkali metal salt such as a K salt, an Na salt and an Li salt, and a quaternary salt such as triethylammonium and pyridinium).

The concrete examples of the dye represented by Formula (I) are shown below but the present invention is not limited thereto.

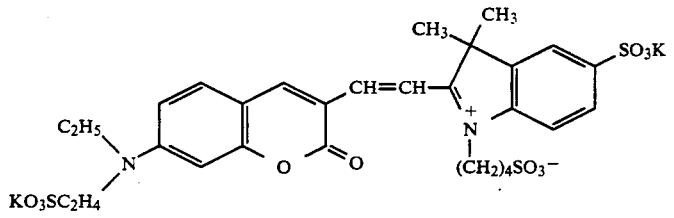

(I-1)

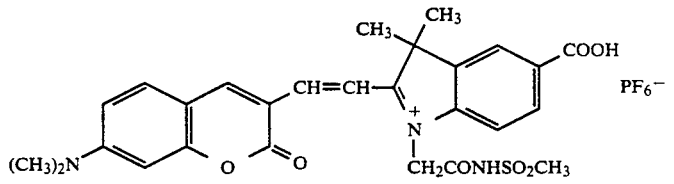

(I-2)

-continued
(I-3)
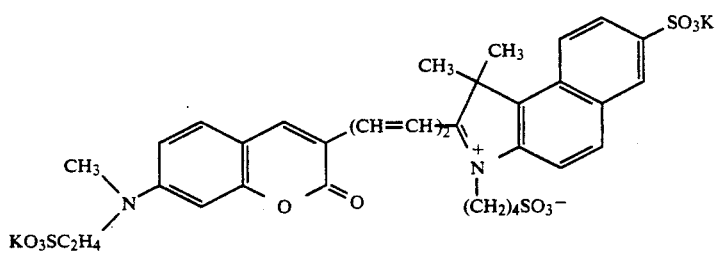
(I-4)
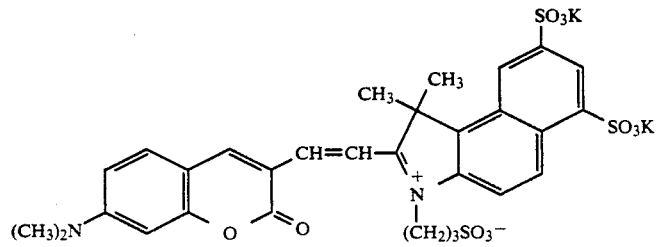
(I-5)
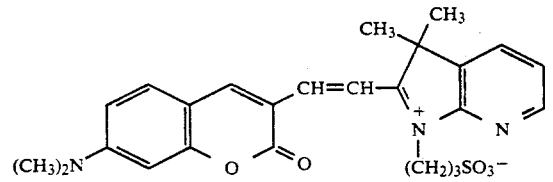
(I-6)
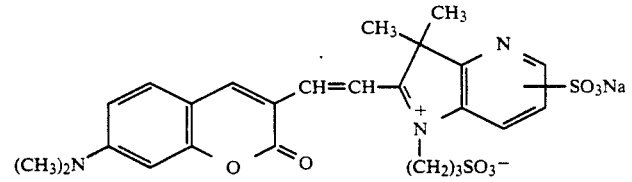
(I-7)
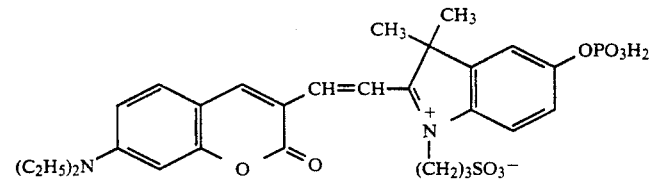
(I-8)
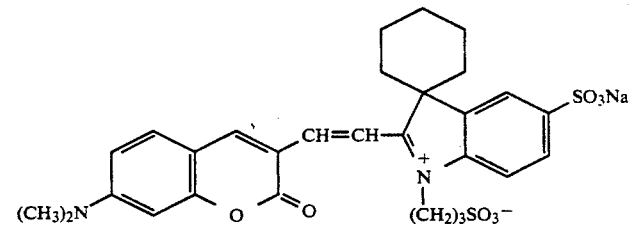
(I-9)
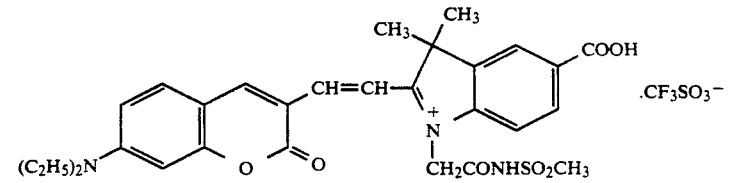

-continued
(I-10)
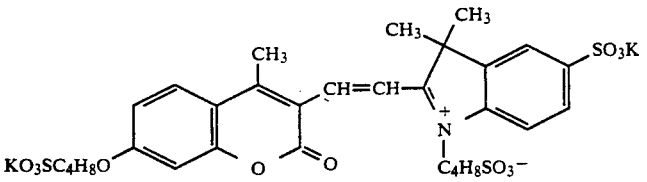
(I-11)
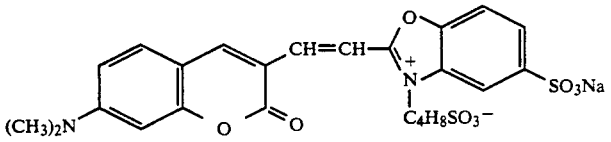
(I-12)
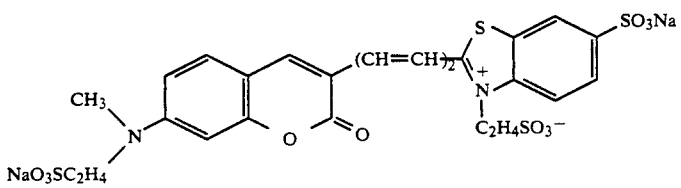
(I-13)
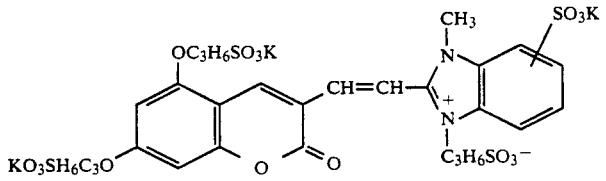
(I-14)
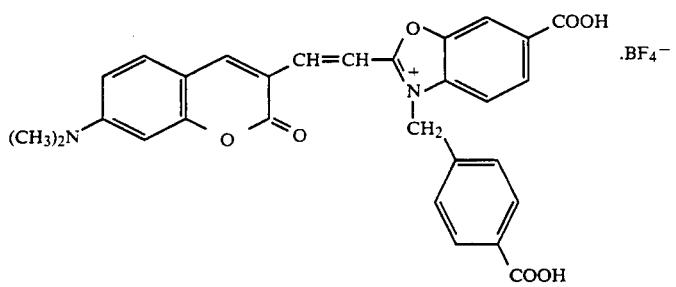
(I-15)
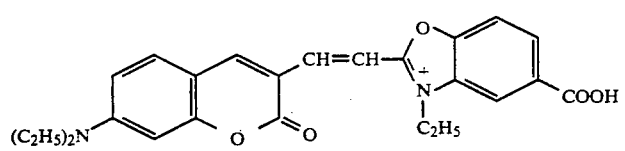
(I-16)
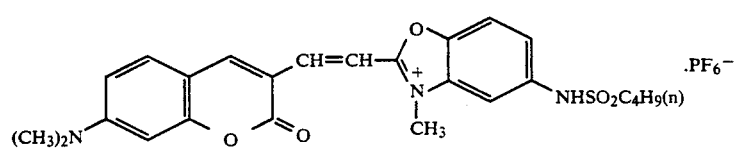
(I-17)
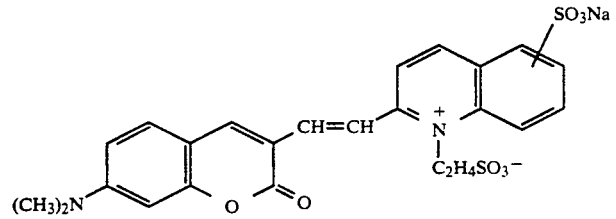

-continued (I-18)

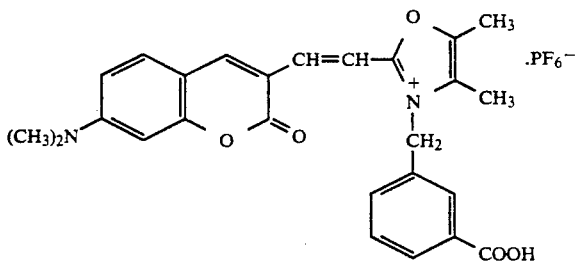

(I-19)

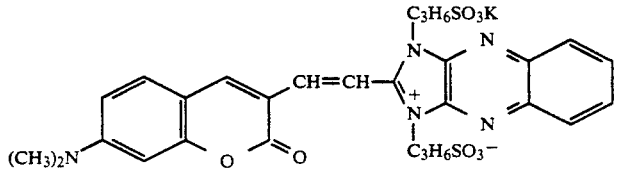

(I-20)

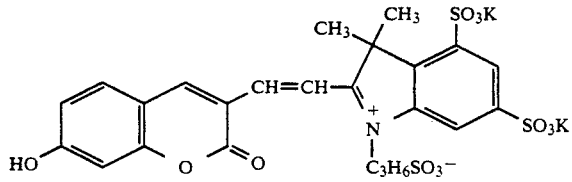

The dye represented by Formula (I) can be synthesized with reference to the methods known to the person of an ordinary skill in the art (for example, a condensation reaction of a quaternary salt of a corresponding base nucleus and a 3-formylcoumarin compound) and the methods described in JP-A-55-88047 (the term "JP-A" as used herewith means an unexamined published Japanese patent application), and "The Cyanine Dyes and Related Compounds", by F. Hamer, International Publishers, 1964.

The dye represented by Formula (I) can be used in any of an emulsion layer and the other hydrophilic colloid layers (an intermediate layer, a protective layer, an anti-halation layer, and a filter layer). It may be used in a single layer or plural layers.

The dye represented by Formula (I) can be used in an arbitrary amount which is effective. It is preferably used so that an optical density falls within the range of 0.5 to 3.0 per one side on a support. The addition amount thereof is preferably 0.5 to 1000 mg, more preferably 1 to 500 mg in a total amount per square meter of the photographic material. An addition timing may be at any step before coating.

The dye represented by Formula (I) can be added to a hydrophilic colloid layer constituting a silver halide photographic material by various publicly known methods. For example, the following methods are available:

(1) a method in which the dye of the present invention is dissolved directly in an emulsion layer or a hydrophilic colloid layer or dispersed in a form of a solid fine grain, or a method in which after dissolving or dispersing the dye in an aqueous solution or a solvent immiscible with water, it is incorporated into a hydrophilic colloid layer;

(2) a method in which a hydrophilic polymer having a charge opposite to that of a dye ion is coexisted as a mordant and a dye is localized in a specific layer by an interaction of the mordant with a dye molecule, wherein the polymer mordant means a polymer containing a secondary amino group and a tertiary amino group, a polymer having a nitrogen-containing heterocyclic ring portion, and a polymer containing a quaternary cation group thereof, and has preferably a molecular weight of 5,000 or more, particularly preferably 10,000 or more; and (3) a method in which the dye is dissolved with an aid of a surface active agent.

An oligomer or polymer surface active agent can be given as a useful surface active agent.

The solid fine grain dispersion of the dye of the present invention represented by Formula (I) can be prepared in the presence of a dispersant by a conventional pulverizing method (for example, a ball mill, a vibration ball mill, a planetary ball mill, a sand mill, a colloid mill, a jet mill, and a roll mill), wherein a solvent (for example, water and alcohol) may be coexisted. Further, after dissolving the dye of the present invention in a suitable solvent, a poor solvent for the dye of the present invention may be added to precipitate a fine crystal powder, wherein a surface active agent for dispersion may be used. Alternatively, the dye is dissolved by controlling pH and then a fine crystal may be precipitated by changing pH.

The fine crystal grains of the dye of the present invention contained in the dispersion generally have an average grain size of 10 μm or less, preferably from 0.005 μm to 10 μm, more preferably from 0.01 μm to 1 μm, most preferably from 0.01 μm to 0.5 μm. It is preferably 0.1 μm or less in some cases.

Gelatin is typical as a hydrophilic colloid, and in addition, there can be used anyone which is known as capable of using for photography.

Preferred as the silver halide emulsion used in the present invention are silver bromide, silver bromoiodide, silver bromochloroiodide, silver bromo-chloride, and silver chloride.

The silver halide grain used in the present invention is of a regular crystal form such as cube and octahedron, an irregular form such as sphere and a plate, or a composite form of these crystal forms. Further, the mixture of the grains having various crystal forms can be used but the grains having a regular crystal form are preferably used.

With respect to a silver halide grain, a photographic emulsion, a preparation method thereof, a binder or a protective colloid, a hardener, a sensitizing dye, a stabilizer, and an anti-foggant, the contents described at the 18th line of a left lower column at 18 page to the 17th line of a left lower column at page 20 of JP-A-3-238447 can be applied to the present invention as they are.

The light-sensitive material according to the present invention may contain one or more kinds of a surface active agent for the various purposes such as a coating aid, an anti-electrification, an improvement in a sliding property, an emulsion dispersion, an anti-adhesiveness, and an improvement in the photographic characteristics (for example, a development acceleration, a hardening of a gradation and a sensitization).

The light-sensitive material prepared according to the present invention may contain a dye other than the dye of the present invention as a filter dye or for the various purposes of an anti-irradiation, an anti-halation and others. There are preferably used as such the dye, an oxonol dye, a hemioxonol dye, a styryl dye, a merocyanine dye, an anthraquinone dye, and an azo dye, and in addition, there are useful as well a cyanine dye, an azomethine dye, a triarylmethane dye, and a phthalocyanine dye. If these dyes are water soluble, they can be added already dissolved in water, and if they are hardly soluble in water, they can be added as a solid fine grain. It is possible as well to add an oil soluble dye to a hydrophilic colloid layer emulsifying by an oil-in-water dispersion method.

With respect to a multilayer and multicolor photographic material, a support, a method for coating a photographic emulsion, an exposing means for a light-sensitive material, and a photographic processing of a light-sensitive material, there can be applied the contents described at the 14th line of a right lower column at page 20 to the 2nd line of a right upper column at page 27 of JP-A-3-238447.

EXAMPLES

Example 1

To 1 liter of water were added 6 g of potassium bromide and 7 g of gelatin. The resulting solution was maintained at 55° C. 37 ml of an aqueous solution containing 4.00 g silver nitrate and 38 ml of an aqueous solution containing 5.9 g potassium bromide were added thereto for 37 sec by a double jet method, followed by adding 18.6 g gelatin. The temperature was raised to 70° C., and 89 ml of an aqueous silver nitrate solution containing 9.8 g silver nitrate was added over a period of 22 minutes. Then, 7 ml of a 25 % ammonia aqueous solution was added to provide a physical ripening for 10 minutes while keeping the temperature stable. Added next were 6.5 ml of a 100% acetic acid solution. Subsequently, an aqueous solution of silver nitrate 153 g and an aqueous solution of potassium bromide were added by a controlled double jet method over a period of 35 minutes while maintaining pAg at 8.5. Then, 15 ml of a 2N potassium thiocyanate aqueous solution was added. After physical ripening for 5 minutes while keeping the temperature as it was, the temperature was lowered to 35° C.

Thus, there were obtained the monodispersed pure silver bromide tabular grains having an average projected area-corresponding circle diameter of 1.10 μm, an average thickness of 0.165 μm, and a diameter fluctuation coefficient of 18.5 %. Thereafter, the soluble salts were removed by a settling method. The temperature was raised to 40° C. and added were 30 g gelatin, 2.35 g phenoxy ethanol, and 0.8 g poly(sodium styrenesulfonate) as a thickener, followed by adjusting the pH and pAg to 5.90 and 8.25, respectively, with caustic soda and a silver nitrate solution.

This emulsion was subjected to the chemical sensitization while stirring and keeping the temperature at 56° C. First, 0.043 mg thiourea dioxide was added and the emulsion was left standing for 22 minutes to subject it to a reduction sensitization. Then, 20 mg 4-hydroxy-6-methyl-1,3,3*a*,7-tetrazaindene and 400 mg of a sensitizing dye with the following chemical structure were added:

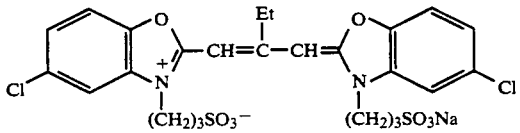

Further, 0.83 g calcium chloride was added. Subsequently, added were 1.3 mg sodium thiosulfate, 2.7 mg Selenium compound 1, 2.6 mg chlorauric acid, and 90 mg potassium thiocyanate, and the solution was cooled down to 35° C. 40 minutes later.

Thus, the silver halide tabular grains T-1 was prepared.

Selenium compound-1

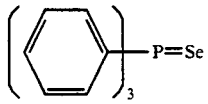

Preparation of a Coated Sample

The following compounds per mole of silver halide of T-1 were added to prepare the coating solutions for preparing the coated samples.

| | |
|---|---|
| Gelatin (including gelatin contained in an emulsion) | 65.6 g |
| Trimethylol propane | 9 g |
| Dextrane (average molecular weight: 39,000) | 18.5 g |
| Poly(sodium styrenesulfonate) (an average molecular weight: 600,000) | 1.8 g |
| Hardener/1,2-bis(vinylsulfonylacetamide) ethane an addition amount was adjusted so that a swelling ratio became 230%. | |
| 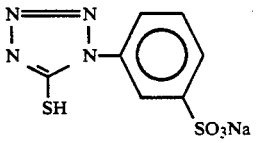 | 34 mg |
| 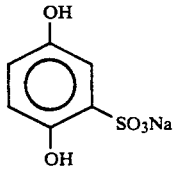 | 4.8 g |

A surface protective layer was coates so that the coated amounts of the respective components became as shown:

| Composition of the surface protective layer | Coated Amount |
|---|---|
| Gelatin | 0.966 g/m$^2$ |
| Poly(sodium acrylate) (average molecular weight: 400,000) | 0.023 g/m$^2$ |
| 4-Hydroxy-6-methyl-1,3,3a,7-tetrazaindene | 0.015 g/m$^2$ |
| 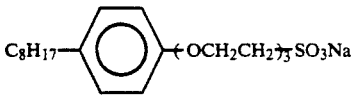 | 0.013 g/m$^2$ |
| $C_{16}H_{33}O(CH_2CH_2O)_{10}H$ | 0.045 g/m$^2$ |
| $C_{17}H_{33}CON(CH_3)CH_2CH_2SO_3Na$ | 0.0065 g/m$^2$ |
| $C_8F_{17}SO_2N(C_3H_7)(CH_2CH_2O)_{15}H$ | 0.003 g/m$^2$ |
| $C_8F_{17}SO_2N(C_3H_7)(CH_2CH_2O)_4(CH_2)_4SO_3Na$ | 0.001 g/m$^2$ |
| 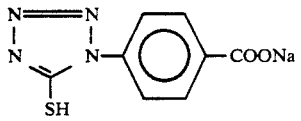 | 1.7 g/m$^2$ |
| Polymethyl methacrylate (an average grain size: 3.7 μm) | 0.087 g/m$^2$ |
| Proxel (pH was adjusted to 7.4 with NaOH) | 0.0005 g/m$^2$ |

Preparation of a Support

(1) Preparation of a dye dispersion D-1 for coating a subbing layer

The dye (I-2) of the present invention was processed with a ball mill by the method described below.

434 ml Water and 791 ml of a 6.7 % aqueous solution of surface active agent Triton X-200 (TX-200) were put in a 2 liter ball mill and 20 g of the dye (I-2) was added to this solution. The 400 ml (diameter: 2 mm) of zirconium oxide (ZrO) beads were added and the content was crushed for 4 days. Then, 160 g of a 12.5 % gelatin aqueous solution was added. After deforming, the mixture was filtered to remove the ZrO beads. An observation of the dye dispersion showed that the particle sizes of the crushed dye widely ranged from about 0.05 to 1.15 μm and that an average particle size was about 0.37 μm.

Further, a centrifugal procedure was applied to remove dye particles having the sizes of 0.9 μm or more. Thus, the dye dispersion D-1 was obtained.

(2) Preparation of a Support

The surface of a biaxially stretched polyethylene terephthalate film having a thickness of 183 μm was subjected to a corona discharge treatment, and the first subbing layer coating solution having the following composition was coated thereon with a wire bar coater so that the coated amount became 5.1 ml/m$^2$, followed by drying at 175° C. for one minute.

Next, the first subbing layer was also provided placed on the opposite side of the support in the same manner. Polyethylene terephthalate containing 0.04 wt % of the dye having the following chemical structure was used:

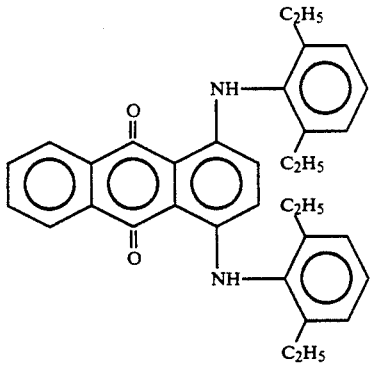

| | |
|---|---|
| Butadiene-styrene copolymer latex solution (a solid content: 40%, butadiene/styrene weight ratio: 31/69) | 79 ml |
| $nC_6H_{13}OOCCH_2$ / $nC_6H_{13}OOCCH-SO_3Na$ was contained as an emulsion dispersant in the latex solution in a proportion of 0.4 wt % based on a latex solid content | |
| Sodium 2,4-dichloro-6-hydroxy-s-triazine (4% solution) | 20.5 ml |
| Distilled water | 900.5 ml |

The second subbing layers having the following composition were applied on the above both first subbing layers layer by layer with the wire bar coater so that the coated amounts of the respective components became as shown below, followed by drying at 150° C.:

| | |
|---|---|
| Gelatin | 160 mg/m$^2$ |
| Dye dispersion D-1 (as a solid content of the dye) | 35 mg/m$^2$ |
| 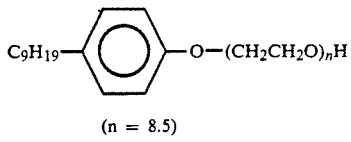 (n = 8.5) | 8 mg/m$^2$ |
| 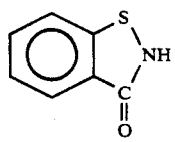 | 0.27 mg/m$^2$ |
| Matting agent (polymethyl methacrylate with an average grain size of 2.5 μm) | 2.5 mg/m$^2$ |

Preparation of a Photographic Material

The foregoing emulsion layer and surface protective layer were provided on the both sides of the support prepared above by a simultaneous extrusion method to thereby prepare the photographic material 1-1. Further, the photographic materials 1-2 to 1-9 were prepared in the same manner as the photographic material 1-1 except that the solid fine grain dispersion contained in the second subbing layer was replaced with the respective dyes shown in Table 1.

The coated silver amount per one side was set at 1.75 g/m$^2$.

TABLE 1

| Photographic material | Dye | Coated amount on one side |
|---|---|---|
| 1-1 (Invention) | I-2 | 35 mg/m$^2$ |
| 1-2 (Invention) | I-9 | 35 mg/m$^2$ |
| 1-3 (Invention) | I-14 | 35 mg/m$^2$ |
| 1-4 (Invention) | I-15 | 35 mg/m$^2$ |
| 1-5 (Invention) | I-16 | 35 mg/m$^2$ |
| 1-6 (Invention) | I-18 | 35 mg/m$^2$ |
| 1-7 (Comparison) | *1 | 35 mg/m$^2$ |
| 1-8 (Comparison) | *2 | 35 mg/m$^2$ |
| 1-9 (Comparison) | — | — |

*1: Comparative dye 1.
*2: Comparative dye 2, which was dissolved and became even in dispersing.

Comparative dye 1: the compound described in JP-6440827

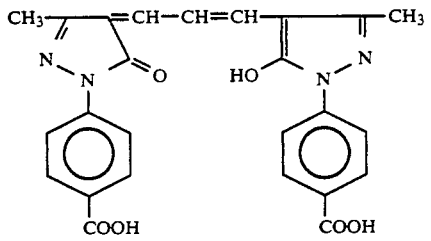

Comparative dye 2

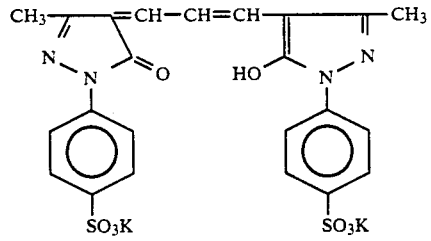

Evaluation of the Photographic Performances

A GRENEX ortho screen HR-4 manufactured by Fuji Photo Film Co., Ltd. was tightly contacted to one side of a photographic material with the aid f a cassette and the photographic material was subjected to an X ray sensitometry. An exposure was adjusted by changing the distance between an X ray tube and the cassette. After exposing, the photographic material was subjected to a processing with an automatic processor int he following developing solution and fixing solution. A sensitivity was expressed by a value relative to that of the photographic material 1-9, which was set at 100.

Measurement of a Sharpness (MTF)

The above cassette (the HR-4 screen was sticked to both sides thereof) and the processing with the automatic processor were combined to measure MTF. The measurement was carried out at an aperture of 30 μm×500 μm and the sharpness was evaluated with an MTF value having a space frequency of 1.0 cycle/mm.

Measurement of a Residual Color

An unexposed photographic film was subjected to the processing with the above automatic processor, and then a green color transmission density thereof was measured through a Macbeth status A filter. Meanwhile, a non-subbed blue-colored polyethylene terephthalate support was subjected to a measurement of a green color transmission density, and a net value obtained by deducting the latter value from the former one was evaluated as a residual color density.

The automatic processor used for this experiment was an automatic processor FPM-9000 type manufactured by Fuji Photo Film Co., Ltd., which was modified so as to equip an infrared dryer in a drying unit, and the processing steps therefor are as shown in the following Table 2. An average processing amount of a light-sensitive material is about 200 sheets (as a 10×12 inch paper) per day.

TABLE 2

| Processing step | Amount of solution in processing bath (liter) | Temperature (°C.) | Path length (mm) | Time (sec) |
|---|---|---|---|---|
| Development | 15 | 35 | 613 | 8.8 |
| (Solution surface area to processing bath volume ratio = 25 cm$^2$/liter) | | | | |
| Fixing | 15 | 32 | 539 | 7.7 |
| Rinsing | 13 | 17 | 263 | 3.8 |
| | | Flowing water | | |
| Squeeze | | | 304 | 4.4 |
| Drying | | 58 | 368 | 5.3 |
| Total | | | 2087 | 30.0 |

The processing solutions and replenishing solutions are as follows:

Development Processing

Preparation of the Condensed Solutions

| | |
|---|---|
| (1) Developing solution: | |
| Part agent A | |
| Potassium hydroxide | 330 g |
| Potassium sulfite | 630 g |
| Sodium sulfite | 255 g |
| Potassium carbonate | 90 g |
| Boric acid | 45 g |
| Diethylene glycol | 180 g |
| Diethylenetriaminepeantacetic acid | 30 g |
| 1-(N,N-diethylamino)-ethyl-5-mercapto-tetrazole | 0.75 g |
| Hydroquinone | 450 g |
| 4-Hydroxymethyl-4-methyl-1-phenyl-3-pyrazolidone | 40 g |
| Water was added to | 4125 ml |
| Part agent B | |
| Diethylene glycol | 525 g |
| 3-3'-Dithiobishydrocinnamic acid | 3 g |
| Glacial acetic acid | 102.6 g |
| 5-Nitroindazole | 3.75 g |
| 1-Phenyl-3-pyrazolidone | 65 g |
| Water was added to | 750 ml |
| Part agent C | |
| Glutaraldehyde (50 wt/wt %) | 150 g |
| Potassium bromide | 15 g |
| Potassium metabisulfite | 105 g |
| Water was added to | 750 ml |
| (2) Fixing solution: | |
| Ammonium thiosulfate (70 wt/vol %) | 3000 ml |
| Disodium ethylenediaminetetracetate dihydrate | 0.45 g |
| Sodium sulfite | 225 g |
| Boric acid | 60 g |
| 1-(N,N-dimethylamino)-ethyl-5-mercapto-tetrazole | 15 g |
| Tartaric acid | 48 g |
| Glacial acetic acid | 675 g |
| Sodium hydroxide | 225 g |

-continued

| | |
|---|---|
| Sulfuric acid (36 N) | 58.5 g |
| Aluminum sulfate | 150 g |
| Water was added to | 600 ml |
| pH | 4.68 |

Preparation of the Processing Solutions

The above condensed developing solution was filled in the following vessel by each part agent. This vessel is constituted by combining the respective part vessels of the part agents A, B and C with the vessel itself so as to make one vessel.

Also, the above fixing solution was filled as well in the similar vessel.

First, 300 ml of an aqueous solution containing 54 g acetic acid and 55.5 g potassium bromide as a starter was put in a developing bath.

The upside-down vessels containing the above processing solutions were inserted in the drilling blades disposed in the processing solution stock tanks to break the sealing membranes provided on the caps, and the respective processing solutions in the vessels were filled in the stock tanks.

These respective processing solutions were filled in a developing bath and a fixing bath of an automatic processor in the following ratio by operating the pumps each equipped in the automatic processor.

Further, every time a light-sensitive material was processed by eight sheets (as a 10×12 inch paper), the stock processing solutions were diluted with water in the following ratios to replenish to the processing baths in the automatic processor.

| | |
|---|---|
| Developing solution: | |
| Part agent A | 55 ml |
| Part agent B | 10 ml |
| Part agent C | 10 ml |
| Water | 125 ml |
| pH | 10.50 |
| Fixing solution: | |
| Condensed solution | 80 ml |
| Water | 120 ml |
| pH | 4.62 |

City water was filled in a rinsing bath. The results are shown in Table 3.

TABLE 3

| Photographic material | Dye | Relative*3 sensitivity | MTF | Residual color |
|---|---|---|---|---|
| 1-1 (Invention) | I-2 | 100 | 0.56 | 0.01 |
| 1-2 (Invention) | I-9 | 100 | 0.56 | 0.01 |
| 1-3 (Invention) | I-14 | 100 | 0.55 | 0.01 |
| 1-4 (Invention) | I-15 | 100 | 0.56 | 0.01 |

TABLE 3-continued

| Photographic material | Dye | Relative*3 sensitivity | MTF | Residual color |
|---|---|---|---|---|
| 1-5 (Invention) | I-16 | 100 | 0.56 | 0.01 |
| 1-6 (Invention) | I-18 | 100 | 0.56 | 0.01 |
| 1-7 (Comparison) | *1 | 88 | 0.55 | 0.03 |
| 1-8 (Comparison) | *2 | 80 | 0.56 | 0.03 |
| 1-9 (Comparison) | — | 100 | 0.42 | 0.00 |

*1: Comparative dye 1.
*2: Comparative dye 2.
*3: Relative sensitivity on a front side.

It can be found from the results summarized in Table 3 that the use of the dyes of the present invention results in a photographic material providing a less reduction of sensitivity and an excellent sharpness as well as less residual color.

What is claimed is:

1. A silver halide photographic material comprising a support and provided thereon at least one hydrophilic colloid layer containing a dye represented by formula (I):

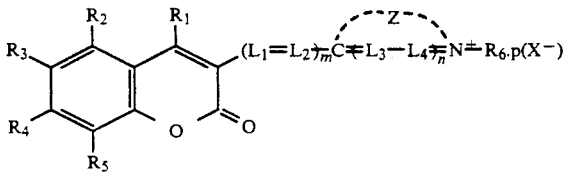

wherein Z represents a group of non-metallic atoms necessary to form a 5 or 6-membered nitrogen-containing heterocyclic ring; $R_1$, $R_2$, $R_3$, $R_4$ and $R_5$ each represent a hydrogen atom or a monovalent group, and $R_3$ and $R_4$ and/or $R_4$ and $R_5$ may be combined to form a 5 or 6-membered ring; $R_6$ represents an alkyl group, an alkenyl group or an aryl group, which may be substituted; $L_1$, $L_2$, $L_3$ and $L_4$ each represent a substituted or unsubstituted methine group; $X^-$ represents an anion; m represents 1 or 2; n represents 0 or 1; and p represents 0, ½ or 1, provided that when the dye forms an intermolecular salt, p is 0.

2. The silver halide photographic material of claim 1, wherein the dye represented by formula (I) is contained in a form of a solid fine grain dispersion.

3. The silver halide photographic material of claim 2, wherein the solid fine grains of the dye contained in the dispersion have an average size of 10 μm or less.

4. The silver halide photographic material of claim 3, wherein the solid fine grains of the dye contained in the dispersion have an average size of 0.005 μm to 10 μm.

5. The silver halide photographic material of claim 4, wherein the solid fine grains of the dye contained in the dispersion have an average size of 0.01 μm to 1 μm.

6. The silver halide photographic material of claim 1, wherein the amount of a dye represented by formula (I) is 0.5 to 1000 mg in a total amount per square meter of the photographic material.

* * * * *